United States Patent [19]

Ohki

[11] Patent Number: 4,869,941

[45] Date of Patent: Sep. 26, 1989

[54] INDICATION ELEMENT WITH PROTECTIVE LAYER AND PROCESS FOR PRODUCING THE SAME

[75] Inventor: Sadayuki Ohki, Suwa, Japan

[73] Assignee: Fuji Kagakushi Kogyo Co., Ltd., Osaka, Japan

[21] Appl. No.: 74,192

[22] Filed: Jul. 13, 1987

[30] Foreign Application Priority Data

Jul. 14, 1986 [JP] Japan ..... 61-108370[U]
Feb. 6, 1987 [JP] Japan ..... 62-27041
Feb. 10, 1987 [JP] Japan ..... 62-29060

[51] Int. Cl.[4] ..... B41M 7/02

[52] U.S. Cl. ..... 428/40; 283/74; 283/75; 283/81; 428/204; 428/913; 428/914

[58] Field of Search ..... 428/915, 195, 207, 913, 428/914, 916, 204, 40; 283/74, 75, 81

[56] References Cited

U.S. PATENT DOCUMENTS 4,421,816 12/1983 Arnold ..... 428/204
4,713,365 12/1987 Harrison ..... 428/913

FOREIGN PATENT DOCUMENTS 58-67497 4/1983 Japan .
59-95169 6/1984 Japan .
60-19588 1/1985 Japan .

*Primary Examiner*—Ellis P. Robinson
*Assistant Examiner*—P. R. Schwartz
*Attorney, Agent, or Firm*—Armstrong, Nikaido, Marmelstein, Kubovcik & Murray

[57] ABSTRACT

An indication element with a protective layer which comprises a receiving medium having an image in a desired pattern on one side thereof, said image being formed by transferring a transferable colored ink of a thermal transfer ink sheet to said receiving medium preferably by means of a thermal printer; and a laminating material laminated to the image-bearing side of said receiving medium, at least the surface layer of said receiving medium on the image-bearing side or at least the surface layer of said laminating material on the side in contact with said receiving medium being compatible with the vehicle of said transferable colored ink. The indication element has a clear image without defects caused by flowing of the image formed on the receiving medium. The production of the indication element can be automatized due to the formation of an image by means of a thermal printer.

14 Claims, 4 Drawing Sheets

INDICATION ELEMENT WITH PROTECTIVE LAYER AND PROCESS FOR PRODUCING THE SAME

BACKGROUND OF THE INVENTION

The present invention relates to an indication element with a protective layer and a process for producing the same.

There are many kinds of indication elements for use in sheet-like articles with a back number and other information which are attached to the breast or back of wear of player in a variety of sports competitions; name cards or tags, and nameplates or doorplates for identification of a person or a variety of places such as a school, company or government office; boards indicating schedules of trains, streetcars, buses or the like; a variety of information boards indicating names of stations, etc; boards indicating names of town or street numbers; and a variety of indoor or outdoor signboards.

In the case of these indication elements, the format for a kind of indication element is unified but many kinds of produce which have different indication contents with each other must be produced for every kind of indication element. For this reason, heretofore, the production of such indication elements was a typical case of a multikind and small-quantity production.

Accordingly, the indication elements were generally produced by hand. However, there has been a demand for automatization of the production thereof to reduce price due to a rise in labor cost and a need for shortening the period from ordering to delivery.

An attempt to use as an indication element a label or paper sheet on which print images were produced by means of a computer or word processor was made. However, an indication element of good quality was not obtainable.

One of the reasons therefor is as follows: In the case of a conventional handwritten indication element, an image was drawn on a resin sheet by using a paint having good weatherability and abrasion resistance. However, in the case of utilizing a computer for producing print images, an ink which gave a print image having a fastness comparable to that obtained by using the conventional paint and also having a property of forming a print image on a resin sheet was unavailable.

In order to over the problem of poor fastness of the printed image of the ink, the present inventor made a resin film laminated to the surface of a resin sheet on which a print image was previously formed. However, the ink of the print image flowed by the heat and pressure during the lamination, whereby the print image was deformed so that the resulting article was not acceptable as an indication element.

As a result of trial and error, the present inventor has developed an indication element which has a clear image, even though the element is produced by utilizing a lamination technique.

SUMMARY OF THE INVENTION

The present invention provides an indication element with a protective layer which comprises a receiving medium having an image in a desired pattern on one side thereof, said image being formed by transferring a transferable colored ink of a thermal transfer ink sheet to said receiving medium; and a laminating material laminated to the image-bearing side of said receiving medium, at least the surface layer of said receiving medium on the image bearing side or at least the surface layer of said laminating material on the side in contact with said receiving medium being compatible with the vehicle of said transferable colored ink.

The present invention further provides a process for producing an indication element with a protective layer which comprises: transferring a transferable colored ink of a thermal transfer ink sheet to a receiving medium to form an image in a desired pattern on the receiving medium by means of a thermal printer, and laminating a laminating material to the image-bearing side of said receiving medium under heating, wherein at least the surface layer of said receiving medium on the image-bearing side or at least the surface layer of said laminating material on the side in contact with said receiving medium being compatible with the vehicle of said transferable colored ink.

DETAILED DESCRIPTION

Figure 1:
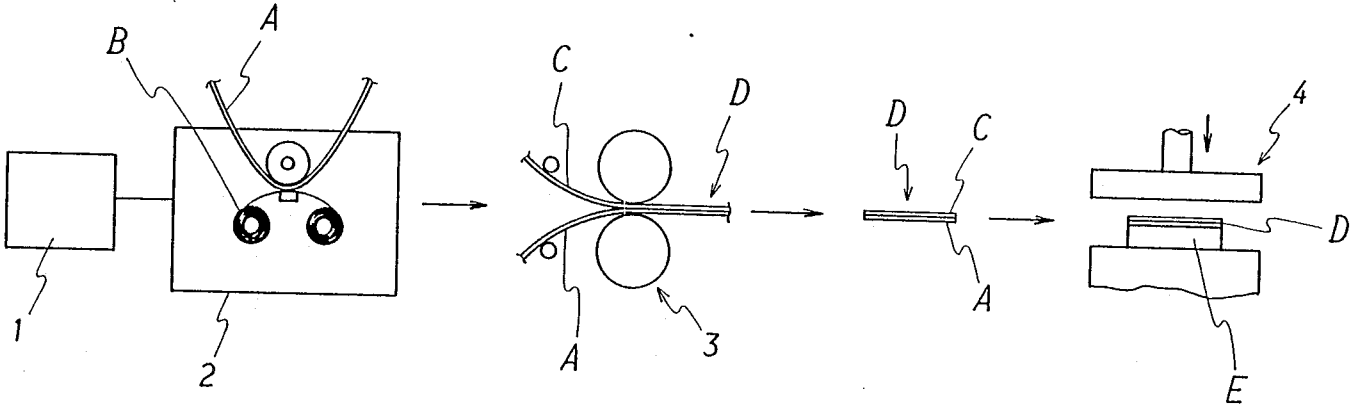
FIG. 1 is a schematic view showing an embodiment of the process for producing an embodiment of the indication element of the present invention.

In accordance with the present invention, an image of the transferable colored ink transferred to the receiving medium is united either to the receiving medium in the case of using the receiving medium with the surface layer compatible with the transferable colored ink or to the laminating material in the case of using the laminating material with the surface layer compatible with the transferable colored ink. The uniting is effectd by application of heat and pressure during the lamination step. The image once united to the receiving medium or laminating material does not flow when it is further heated at a high temperature higher than the melting temperature of the ink during the lamination step and maintains substantially the same clear shape as that of the original image formed on the receiving medium. Thus the present invention provides an indication element with a protective layer having a clear image.

Further, in accordance with the process of the present invention wherein an image is formed by a thermal transfer printing method using a thermal printer, a clear print image can be formed readily. Moreover, since an information processing function of a computer or the like can be directly used in the thermal transfer printing method, the production of this kind of indication element, the automatication of which was heretofore difficult due to multikind and small-quantity production, can be automatized. Accordingly, an indication element having a beautiful image comparable to that handwritten by a skilled craftsman can be obtained in a high productivity.

Hereinafter, the term "sheet" is intended to include a film, unless otherwise noted.

According to an embodiment of the present invention, an image receiving medium wherein at least a surface layer thereof is compatible with the vehicle of a transferable colored ink used for forming an image thereon is used.

The embodiment will be explained hereinafter.

At least the surface layer of the receiving medium is composed of a thermoplastic resin compatible with the vehicle of the transferable colored ink. It is preferable that the thermoplastic resin constituting the surface layer has a softening temperature lower than the heating temperature in the lamination step. The uniting of an image to the surface layer of the receiving medium is more readily and completely effected, because the surface layer is softened during the lamination step.

Examples of the resin used in the receiving medium include polyamide resins preferably having a softening temperature of about 50° C. to about 120° C.; polyurethane resins; polyester resins preferably having a molecular weight of about $2\times10^4$ to about $3\times10^4$; ethylene-vinyl acetate copolymer resins preferably having a softening temperature of about 50° C. to about 90° C., butyral resins such as polyvinyl butyral, vinyl chloride-vinyl acetate copolymer resins, low density polyethylenes, syndiotactic-1, 2-polybutadiene preferably having a melting temperature of about 75° C. to about 90° C., stryene-butadiene copolymers, vinyl chloride resins, chlorinated polyethylene resins, and polypropylene resins.

These resins may be used singly or as admixtures of two or more kinds thereof. Other resin or additive may be added to the above-mentioned specific resin used as a main component.

The image receiving medium used in the present invention may be a sheet formed from the above-specified resin per se. Alternately a sheet formed by applying the above-specified resin to another sheet material such as cloth, paper or sheet of other resin in a desired coating thickness also may be used. A thickness of 10 to 100 μm is sufficient for the thickness of the sheet of the specific resin or the coating of the specific resin.

An adhesive may be applied to the opposite side of the receiving medium so as to bond the receiving medium to another article. Instead of the application of the adhesive, the receiving medium per se may be composed of a heat-weldable resin which may be selected from the above specific resins.

A thin flexible sheet is used as the receiving medium to form an image by means of a thermal printer.

If there is a possibility that, when the receiving medium is mounted in a printer, the receiving medium winds round a platen in the case that the back surface of the receiving medium possesses a heat-weldability to the platen or has an adhesive layer, or the receiving medium per se is too soft, a pasteboard such as release paper may be removably attached to the back surface of the receiving medium.

Any conventional thermal transfer ink sheet can be used as the thermal transfer ink sheet without particular limitation. For example, a thermal transfer ink sheet wherein a heat-sensitive transfer ink layer is provided on a support including thin high density papers such as condenser paper and glassine paper, and resin films such as polyester film, polyethylene film and polycarbonate film can be suitably used.

The ink layer may be provided on the support by means of a conventional hot-melt coating or solvent coating using water or organic solvent as a solvent.

If necessary, a conventional sticking-preventive layer such as a silicone resin layer may be provided on the back surface of the support.

As the heat-sensitive transfer ink layer, there can be used either a one-time type ink layer wherein the whole ink of selectively heated portions of the ink layer is completely transferred by one-time use, or a multi-use type ink layer wherein the ink of electively heated portions of the ink layer is not completely transferred by one-time use and the same portion of the ink layer can be used plural times for transfer printing. However, the colored ink of the heat-sensitive transfer ink layer which is melt-transferred to the receiving medium must contain as a main component of the vehicle a resin compatible with the resin constituting at least the surface layer of the receiving medium.

It is preferable to use, as the compatible resin component in the colored ink, the same kind of resin as the above-mentioned resin of the surface layer of the receiving medium used. However, a resin which is different in kind from but has substantially the same solubility parameter as the resin of the surface layer of the receiving medium can be used. Preferably the compatible resin component is used in a proportion of about 3/20 by weight or more of the total amount of the vehicle of the transferable colored ink.

Some combinations of resins which are different in kind from each other but are compatible with each other are shown in Table 1. In Table 1, the item "Compatible resin component of ink vehicle" in the right column means a resin component which is contained in a vehicle of a transferable colored ink and which is compatible with the resin of a receiving medium described in the left column. With respect to each combination shown in Table 1, plural kinds of resins exemplified as the compatible resin component in the ink vehicle for a kind of resin of the receiving medium may be used singly or as admixtures of two or more kinds thereof. An imcompatible resin may be used in combination with the above compatible resin component as a vehicle component with limits not to injure the purpose of the present invention.

TABLE 1

| Resin of receiving medium | Compatible resin component of ink vehicle |
|---|---|
| Polyamide | Polyurethane<br>Chlorinated polyethylene<br>Ethylene-vinyl acetate copolymer<br>Vinyl chloride-vinyl acetate copolymer |
| Polyurethane | Polyamide<br>Chlorinated polyethylene<br>Ethylene-vinyl acetate copolymer<br>Vinyl chloride-vinyl acetate copolymer<br>Polyvinyl butyral |

TABLE 1-continued

| Resin of receiving medium | Compatible resin component of ink vehicle |
|---|---|
| Polyester | Styrene-butadiene copolymer |
| | Ethylene-vinyl acetate copolymer |
| | Vinyl chloride-vinyl acetate copolymer |
| Ethylene-vinyl acetate copolymer | Polyethylene |
| | Vinyl chloride-vinyl acetate copolymer |
| | Chlorinated polyethylene |
| | Polyvinyl butyral |
| Vinyl chloride-vinyl acetate copolymer | Ethylene-vinyl acetate copolymer |
| | Polyvinyl chloride |
| | Chlorinated polyethylene |
| | Polyvinyl butyral |
| Polyvinyl butyral | Polyurethane |
| | Ethylene-vinyl acetate copolymer |
| | Vinyl chloride-vinyl acetate copolymer |
| | Polybutadiene |
| | Polyethylene |
| | Polypropylene |
| Polyethylene | Polybutadiene |
| | Styrene-butadiene copolymer |
| | Polypropylene |
| Styrene-butadiene copolymer | Polyester |
| | Polypropylene |
| Polyvinyl chloride | Chlorinated polyethylene |
| | Vinyl chloride-vinyl acetate copolymer |
| Chlorinated polyethylene | Polyamide |
| | Polyurethane |
| | Vinyl chloride-vinyl acetate copolymer |
| Polypropylene | Polyethylene |
| | Styrene-butadiene copolymer |
| | Polyvinyl butyral |

One or more other vehicle components including a variety of waxes or thermoplastic resins, and a viscosity-adjusting agent such as oils can be used together with the specific compatible resin component as the vehicle component of the transferable colored ink used in the present invention with limits not to injure the purpose of the present invention. These auxiliary vehicle components are selected such that the miscibility or compatibility with the above-mentioned compatible resin component, and the characteristic properties of the ink such as viscosity and melting temperature are adjusted to secure the clearness of an image. Any usual dye or pigment can be used as a coloring agent.

Preferably the viscosity of the transferable colored ink is not lower than about 2 poises at 100° C.

In lieu of the one-time type heat-sensitive transfer ink layer, a two or multi-layered structure can be adopted. In the event that the releasability of the colored ink layer from the support in a transfer operation is poor, a layer composed of a wax which is reduced significantly in its viscosity when it is heated in the transfer operation may be provided between the colored ink layer and the support, or an untransferably layer composed of a material having a releasing property such as silicone resin may be provided previously on the support. Further, another transferable layer containing no coloring agent may be provided on the surface of the colored ink layer to prevent an accidental transferring of the colored ink to the receiving medium.

In the case of the multi-use type heat-sensitive transfer ink layer, any conventional ink layer may be used. In particular, an ink layer wherein a transferable colored ink is contained in an untransferable resinous sponge layer is preferably used.

As the laminating material, there can be used any sheet capable of being bonded to the image-bearing surface of the receiving medium when the laminating material is pressed under heating to the receiving medium in the lamination step. The laminating material per se need not have the property of heat-weldability, if the receiving medium has heat-weldability to the laminating material. Examples of the laminating material include films or sheets of rigid polyvinyl chloride, soft polyvinyl chloride, polycarbonate, polyester, acrylic resin, tetrafluoroethylene copolymer and difluoroethylene copolymer.

The laminating material may be a single-layered sheet or a multi-layered sheet. An example of the multi-layered sheet is a sheet consisting of an acrylic resin layer, a tetrafluoroethylene copolymer layer provided on one surface of the acrylic resin layer and a soft or hard vinyl chloride resin layer on the other surface of the acrylic resin layer. The thickness of the laminating material is usually from 3 to 800 μm.

It is enough to practice the present invention if at least one of the laminating material and the receiving medium is transparent. Usually, however, a transparent laminating material is used and the view from the laminating material embraces the image of the indication element.

When a transparent laminating material is used, a right-reading image can be formed on the receiving medium.

A transparent image receiving medium may be used so that the view from the receiving medium embraces the image of the indication element. In that case, mirror reverse images are formed on the receiving medium.

Weatherability of the indication element can be improved by incorporating an ultraviolet absorber or analogous additive into at least one or all of the laminating material, the receiving medium and a foundation mentioned below.

Some embodiments of the process for producing the indication element of the present invention will be explained by referring to the drawings.

First Process (FIG. 1)

Signals corresponding to a pattern processed by a computer 1, such as personal computer, are inputted into a heat-sensitive transfer printer 2, wherein an mage corresponding to the pattern is printed on a receiving medium A by using the thermal transfer ink sheet B.

The receiving medium A on which the print image is formed is fed together with a transparent laminating material C into a laminator 3, wherein the lamination is carried out at a temperature higher than the softening temperature of the thermoplastic resin constituting the receiving medium to give an indication element D. Usualy the heating temperature for the lamination is from 70° to 150° C.

After the lamination step, if necessary, the indication element D may be bonded to a foundation E on the side of the receiving medium A. If the receiving medium A has heat-weldability to the foundation E, the indication element D can be welded to the foundation E on the side of the receiving medium A by means of a hot press machine 4.

Any suitable article can be used as the foundation E depending upon the use of the indication element D.

Examples of the foundations E include plates or sheets of materials such as metal, synthetic resin or wood and fabrics of natural or synthetic fiber.

Further, in the lamination step, the lamination and the bonding to the foundation may be effected simultaneously by putting the laminating material C on the front surface of the receiving medium A while putting the foundation E on the back surface of the receiving medium A, and applying a pressure to the assembly under heating.

Moreover, in the case of an indication element D wherein a transparent receiving medium A is used and a mirror reverse image is formed on the transparent receiving medium A and a laminating material C which may be opaque is laminated to the receiving medium A, the foundation E is bonded to the indication element D on the side of the laminating material C.

Figure 2:
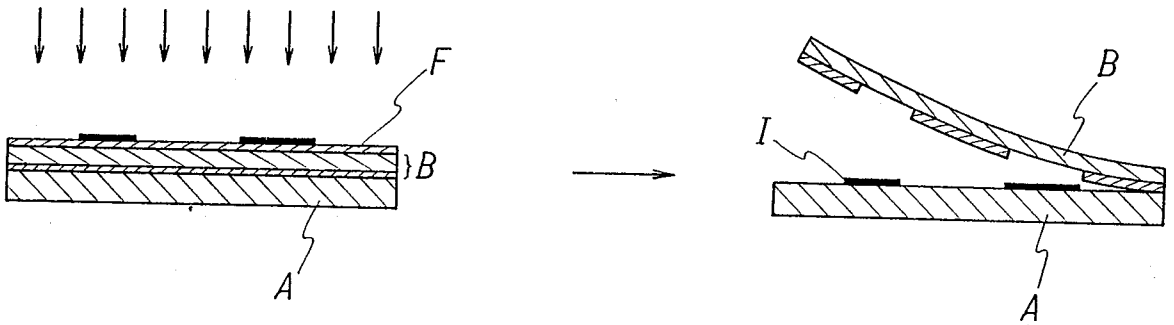
FIG. 2 is a schematic view showing another embodiment of the process for producing said embodiment of the indication element.

Second Process (FIG. 2)

It is possible to form an image on the receiving medium by utilizing heat rays instead of a printer.

According to this process, an original F having an image formed by using a substance having a radiation absorbing property such as carbon black is prepared. The original F is placed on the back surface of thermal transfer ink sheet B which is placed on the receiving medium A on the side of the ink layer. If a thin receiving medium is used, the original F can be placed on the back surface of the receiving medium. The assembly is irradiated with heat rays such as infrared rays, whereby portions of the ink layer corresponding to the image of the original F are molten and transferred to the receiving medium. Subsequent procedures are the same as those of the first process mentioned above.

When the second process is adopted, there can be used an image receiving medium which is previously bonded to a foundation, or a material which is hard at ordinary temperatures, a thick sheet or plate material or a thick cloth as the image receiving medium.

In the case of these receiving media which are used with difficulty in a usual printer, an image can be formed thereon by using a small-sized printer which can be moved manually or automatically on a desk.

Figure 3:
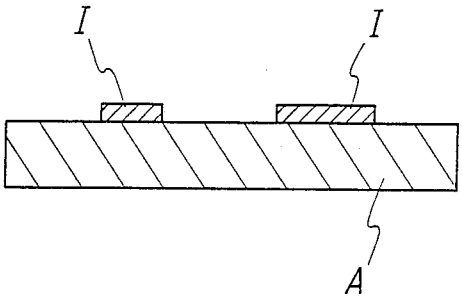
FIG. 3 is a cross-section showing a receiving medium on which an image is formed by a transfer printing.
Figure 4:
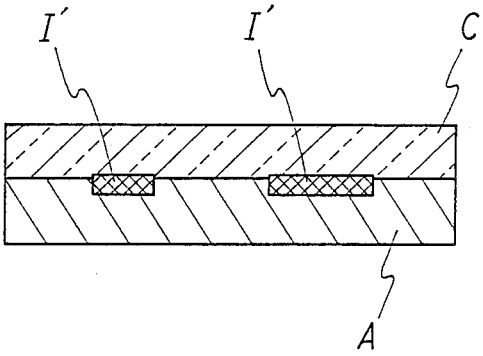
FIG. 4 is a cross-section showing an embodiment of the indication element of the present invention wherein a laminating material is laminated to the receiving medium shown in FIG. 3.

According to the present invention, a laminating sheet C is placed on a receiving medium A having an ink image I formed by transfer as shown in FIG. 3 and laminated thereto, whereby the ink image I is united to the thermoplastic resin of the surface layer of the receiving medium A by the action of heat and pressure during the lamination to give an integrated ink image I' as shown in FIG. 4.

The reasons therefor are that the vehicle of the colored ink contains a resin component which is compatible with at least the surface layer of the receiving medium A and that the thermoplastic resin of the surface layer of the receiving medium A has preferably a softening temperature lower than the laminating temperature. Accordingly, the flowing of the ink image I formed on the receiving A which has been encountered with the conventional method is prevented to give an indication element having a clear image.

According to another embodiment of the present invention, a laminating material wherein at least the surface layer thereof on the side in contact with the receiving medium is compatible with the vehicle of a transferable colored ink used for forming an image on the receiving medium is used.

The embodiment will be explained hereinafter.

An indication element of this embodiment (hereinafter referred to as "second embodiment") is substantially the same as that of the above-mentioned embodiment (hereinafter referred to as "first embodiment") except that the material used as the image receiving medium in the first embodiment is used as the laminating material in the second embodiment, and the material used as the laminating material in the first embodiment is used as the image receiving medium in the second embodiment.

It is also enough to practice the second embodiment if at least one of the image receiving medium and the laminating material is transparent. Usually, however, a transparent image receiving medium is used and the view from the image receiving medium embraces the image of the indication element.

When a transparent image receiving medium is used, a mirror reverse image is formed thereon.

A transparent laminating material may be used so that the view from the laminating material embraces the image of the indication element. In the case, a right-reading image if formed on the image receiving medium.

Figure 5:
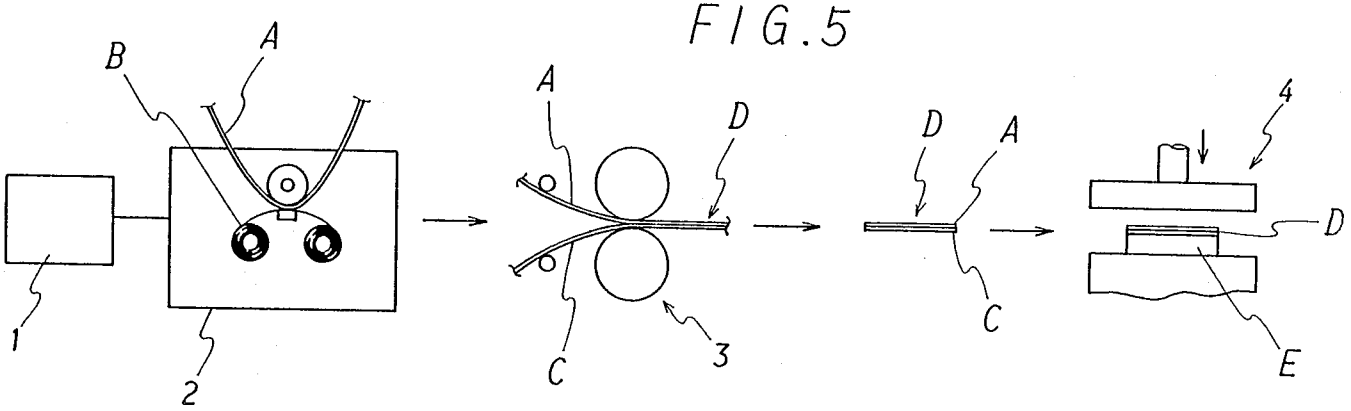
FIG. 5 is a schematic view showing an embodiment of the process for producing another embodiment of the indication element of the present invention.
Figure 6:
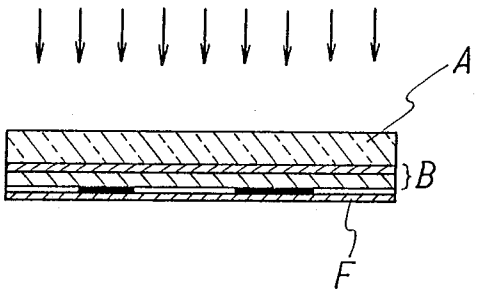
FIG. 6 is a schematic view showing another embodiment of the process for producing said embodiment of the indication element.

FIG. 5 and FIG. 6 show the process for producing the indication element of the second embodiment. In FIGS. 5 and 6, the same reference numerals as in FIGS. 1 and 2 are used to identify the corresponding elements.

The process shown in FIG. 5 is substantially the same as the first process of the first embodiment (FIG. 1) except that usually the foundation E is bonded to the indication element D on the side of the laminating material C.

The process shown in FIG. 6 is substantially the same as the second process of the first embodiment (FIG. 2) except that usually a mirror reverse image is formed on a receiving medium A from an original F having a right-reading image.

Figure 7:
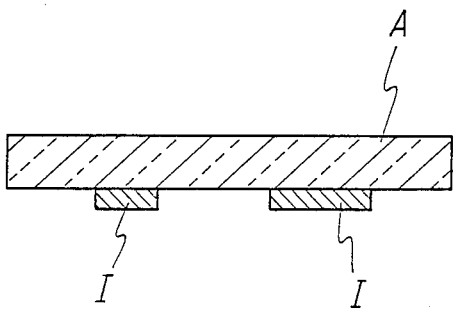
FIG. 7 is a cross-section showing a receiving medium on which an image is formed by a transfer printing.
Figure 8:
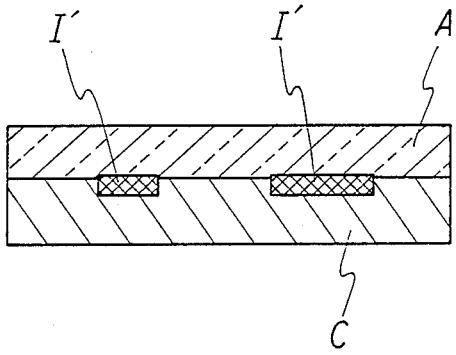
FIG. 8 is a cross-section showing another embodiment of the indication element of the present invention wherein a laminating material is laminated to the receiving medium shown in FIG. 7.

According to the second embodiment, a laminating material C is placed on a receiving medium A having an ink image I formed by transfer as shown in FIG. 7 and laminated thereto, whereby the ink image I is united to the thermoplastic resin of the surface layer of the laminating material C by the action of heat and pressure during the lamination to give an integrated ink image I' as shown in FIG. 8.

The reasons therefor are that the vehicle of the colored ink contains a resin component which is compatible with at least the surface layer of the laminating material C and that the thermoplastic resin of the surface layer of the laminating material C has preferably a softening temperature lower than the laminating temperature. Accordingly, the flowing of the ink image I formed on the receiving medium A which has been encounted with the conventional method is prevented to give an indication element having a clear image.

The present invention will be more specifically described and explained by means of the following Examples. These Examples are intended to illustrate the invention and are not be construed so as to to limit the scope of the invention. It is to be understood that various changes and modifications may be made in the invention without departing from the spirit and scope thereof. In Table 2, "parts" in the formulation of transfer ink means "parts by weight".

EXAMPLES 1 TO 6

A right-reading image was formed on the receiving medium shown in Table 2 in a commercially available thermal printer by using the thermal transfer ink sheet shown in Table 2.

The transparent laminating material shown in Table 3 was laminated to the image-bearing surface of the receiving medium a the temperature shown in Table 3 by means of a commercially available laminator.

The foundation shown in Table 3 was heat-welded to the obtained laminated sheet (except Example 3) on the side of the receiving medium by means of a commercially available hot press machine.

With respect to each of Examples 1 to 6, the flowing of the print image did not occur during the lamination step and an indication element having a clear image was obtained.

When the laminating material used in Example 5 was laminated to the receiving medium used in Example 5 on which a print image was formed by using the thermal transfer ink sheet used in Example 1, the print image was flowed and deformed during the lamination so that it was not readable.

TABLE 2

| | Receiving medium | Thermal transfer ink sheet |
|---|---|---|
| Ex. 1 | Construction: 50 μm thick sheet of ethylene-vinyl acetate copolymer with a release paper bonded to the back surface thereof by welding<br>Melting point: 83° C.<br>Softening point: 53° C. | Support: 6 μm thick polyester film<br>Formulation of transfer ink: 7 parts of wax, 2 parts of ethylene-vinyl acetate copolymer with a softening point of 65° C. and 1 part of carbon black<br>Melting point of transfer ink: 75° C.<br>Viscosity of transfer ink: 3 poises at 100° C.<br>Thickness of transfer ink layer: 3 μm |
| Ex. 2 | " | Support: 6 μm thick polyester film<br>Formulation of transfer ink: 2 parts of wax, 7 parts of ethylene-vinyl acetate copolymer with a softening point of 65° C. and 1 part of carbon black<br>Melting point of transfer ink: 68° C.<br>Viscosity of transfer ink: $10^3$ poises at 100° C.<br>Thickness of transfer ink layer: 3 μm |
| Ex. 3 | Construction: sheet prepared by applying a solution of the same resin as used in Ex. 1 to a plain paper and drying it to form a resin layer with 15 μm thickness | Support: 6 μm thick polyester film<br>Formulation of transfer ink: 2 parts of wax, 7 parts of ethylene-vinyl acetate copolymer with a softening point of 65° C. and 1 part of carbon black<br>Melting point of transfer ink: 68° C.<br>Viscosity of transfer ink: $10^3$ poises at 100° C.<br>Thickness of transfer ink layer: 3 μm |
| Ex. 4 | Construction: 100 μm thick polyamide resin sheet with a release paper bonded to the back surface thereof by welding<br>Melting point: 90° C.<br>Softening point: 50° C. | Support: 6 μm thick polyester film<br>Formulation of transfer ink: 5 parts of wax, 4 parts of polyamide with a softening point of 100° C. and 1 part of carbon black<br>Melting point of transfer ink: 90° C.<br>Viscosity of transfer ink: $10^2$ poises at 100° C.<br>Thickness of transfer ink layer: 5 μm |
| Ex. 5 | Construction: 100 μm thick polyester resin sheet with a release paper bonded to the back surface thereof by welding<br>Molecular weight: $2 \times 10^4$ to $2.5 \times 10^4$<br>Melting point: 120° C. | Support: 15 μm thick condenser paper<br>Formulation of transfer ink: 6 parts of wax, 3 parts of polyester resin with a softening point of 100° C. and 1 part of carbon black<br>Melting point of transfer ink: 85° C.<br>Viscosity of transfer ink: $10^3$ poises at 100° C.<br>Thickness of transfer ink layer: 3 μm<br>(A low-melting point wax layer was provided between the support and the transfer ink layer) |
| Ex. 6 | Construction: 100 μm thick olefin resin sheet with a release paper bonded to the back surface thereof | Support: 15 μm thick condenser paper<br>Formulation of transfer ink: 6 parts of wax, 3 parts of olefin resin with a softening |

TABLE 2-continued

| Receiving medium | Thermal transfer ink sheet |
|---|---|
| by welding<br>Melting point: 100° C.<br>Softening point: 80° C. | point of 85° C. and 1 part of carbon black<br>Melting point of transfer ink: 80° C.<br>Viscosity of transfer ink: 10 poises at 100° C.<br>Thickness of transfer ink layer: 3 μm<br>(A low-melting point wax layer was provided between the support and the transfer ink layer) |

TABLE 3

| | Laminating material | Laminating temp. (°C.) | Foundation | |
|---|---|---|---|---|
| | | | Kind | Bonding method |
| Ex. 1 | 200 μm thick polycarbonate sheet | 120 | 3 mm thick ABS resin plate | Welding of receiving medium to foundation |
| Ex. 2 | 200 m thick three-layered sheet (tetra-fluoroethylene copolymer layer/acrylic resin layer/soft vinyl chloride resin layer) | 120 | cotton cloth | " |
| Ex. 3 | " | 120 | " | " |
| Ex. 4 | 200 μm thick polycarbonate sheet | 120 | 3 mm thick ABS resin plate | Welding of receiving medium to foundation |
| Ex. 5 | " | 140 | " | " |
| Ex. 6 | " | 130 | " | " |

EXAMPLES 7 TO 12

A mirror reverse image was formed on the transparent receiving medium shown in Table 4 in a commercially available thermal printer by using the thermal transfer ink sheet shown in Table 4.

The laminating material shown in Table 4 was laminated to the image-bearing surface of the receiving medium at the temperature shown in Table 4 by means of a commercially available laminator.

With respect to each of Examples 7 to 12, the flowing of the print image did not occur during the lamination step and an indication element having a clear image was obtained.

When the laminating material used in Example 11 was laminated to the receiving medium used in Example 11 on which a print image was formed by using the thermal transfer ink sheet used in Example 7, the print image was flowed and deformed during the lamination so that it was not readable.

TABLE 4

| | Receiving medium | Thermal transfer ink sheet | Laminating material | Laminating temp. (°C.) | Foundation | Bonding method |
|---|---|---|---|---|---|---|
| Ex. 7 | The same as the laminating material used in Ex. 1 | The same as used in Ex. 1 | The same as the receiving medium used in Ex. 1 | 120 | The same as used in Ex. 1 | Welding of laminating material to foundation |
| Ex. 8 | The same as the laminating material used in Ex. 2 | The same as used in Ex. 2 | The same as the receiving medium used in Ex. 2 | 120 | The same as used in Ex. 2 | " |
| Ex. 9 | The same as the laminating material used in Ex. 3 | The same as used in Ex. 3 | The same as the receiving medium used in Ex. 3 | 120 | — | — |
| Ex. 10 | The same as the laminating material used in Ex. 4 | The same as used in Ex. 4 | The same as the receiving medium used in Ex. 4 | 120 | The same as used in Ex. 4 | Welding of laminating material to foundation |
| Ex. 11 | The same as the laminating material used in Ex. 5 | The same as used in Ex. 5 | The same as the receiving medium used in Ex. 5 | 140 | " | " |
| Ex. 12 | The same as the laminating material used in Ex. 6 | The same as used in Ex. 6 | The same as the receiving medium used in Ex. 6 | 130 | " | " |

The foundation shown in Table 4 was heat-welded to the obtained laminated sheet (except Example 9) on the side of the laminating material by means of a commercially available hot press machine.

In addition to the ingredients or elements used in the Examples, other ingredients or elements can be used in the Examples as set forth in the specification to obtain substantially the same results.

What is claimed is:

1. An indication element with a protective layer, comprising:

a receiving medium having an image in a desired pattern thermally printed on one side thereof, said image being an image of a colored heat-sensitive transfer ink comprising a coloring agent and a vehicle transferred from a thermal ink sheet; and a laminating material directly laminated and bonded to the image-bearing surface of said receiving medium by heat and pressure, wherein at least one of the surface layer of said receiving medium on the image-bearing side and the surface layer of said laminating material on the side in contact with said receiving medium is compatible with said vehicle of said colored ink so that said colored ink is directly united to at least one of said surface layers by said heat and pressure, resulting in the colored ink constituting a part of the surface layer of at least one of said surface layers, and wherein at least said surface layer of the receiving medium on the image-bearing side thereof comprises a thermoplastic resin, said resin being compatible with said vehicle of the colored ink and having a softening temperature lower than the laminating 2. The indication element of claim 1, wherein the laminating material is a transparent sheet.

3. The indication element of claim 2, wherein the receiving medium is a thin flexible sheet and a release paper is bonded to the back surface of the receiving medium.

4. The indication element of claim 3, wherein said release paper is bonded to the back surface of the receiving medium through an adhesive layer.

5. The indication element of claim 2, wherein the back surface of the receiving medium is bonded to a foundation.

6. The indication element of claim 5, wherein the foundation is a member selected from the group consisting of a metal plate, a synthetic resin plate, a wood plate and a cloth.

7. The indication element of claim 6, wherein the back surface of the receiving medium is welded to the foundation.

8. An indication element with a protective layer, comprising:

a receiving medium having an image in a desired pattern thermally printed on one side thereof, said image being an image of a colored heat-sensitive transfer ink comprising a coloring agent and a vehicle transferred from a thermal ink sheet; and a laminating material directly laminated and bonded to the image-bearing surface of said receiving medium by heat and pressure, wherein at least one of the surface layer of said receiving medium of the image-bearing side and the surface layer of said laminating material on the side in contact with said receiving medium is compatible with said vehicle of said colored ink so that said colored ink is directly united to at least one of said surface layers by said heat and pressure, resulting in the colored ink constituting a part of the surface layer of at least one of said surface layers, and wherein at least said surface layer of the laminating material on the side in contact with the receiving medium comprises a thermoplastic resin, and resin being compatible with said vehicle of the colored ink, and having a softening temperature lower than the laminating temperature so that said colored ink of said image is directly united to said surface layer, which is softened at the laminating temperature.

9. The indication element of claim 8, wherein the receiving medium is a transparent thin flexible sheet.

10. The indication element of claim 9, wherein a release paper is bonded to the back surface of the laminating material.

11. The indication element of claim 10, wherein said release paper is bonded to the back surface of the laminating material through an adhesive layer.

12. The indication element of claim 9, wherein the back surface of the laminating material is bonded to a foundation.

13. The indication element of claim 12, wherein the foundation is a member selected from the group consisting of a metal plate, a synthetic resin plate, a wood plate and a cloth.

14. The indication element of claim 13, wherein the back surface of the laminating material is welded to the foundation.

* * * * *